US005322113A

United States Patent [19]

Shibuya et al.

[11] Patent Number: 5,322,113

[45] Date of Patent: Jun. 21, 1994

[54] METHOD OF PRODUCING AMORPHOUS ALLOY THIN STRIP FOR COMMERCIAL FREQUENCY BAND TRANSFORMERS

[75] Inventors: Kiyoshi Shibuya; Toru Sato; Nobuo Shiga, all of Chiba, Japan

[73] Assignee: Kawasaki Steel Corporation, Japan

[21] Appl. No.: 936,241

[22] Filed: Aug. 26, 1992

[30] Foreign Application Priority Data

Aug. 30, 1991 [JP] Japan ..... 3-220377

[51] Int. Cl.[5] ..... C22C 33/00

[52] U.S. Cl. ..... 164/463; 164/900; 420/129; 75/10.63; 75/10.64

[58] Field of Search ..... 75/10.63, 10.64; 420/129; 164/462, 463, 900, 423

[56] References Cited

U.S. PATENT DOCUMENTS

| | | | |
|---|---|---|---|
| 4,501,316 | 2/1986 | Ames | 164/463 |
| 4,505,745 | 3/1985 | Hamada | 420/117 |
| 4,617,052 | 10/1986 | Takenouchi | 420/117 |
| 5,100,614 | 3/1992 | Ramanan | 420/129 |

*Primary Examiner*—Paula A. Bradley
*Assistant Examiner*—Rex E. Pelto
*Attorney, Agent, or Firm*—Austin R. Miller

[57] ABSTRACT

A method of producing amorphous alloy thin strip suitable for use in commercial frequency band transformers utilizes a high-quality molten steel suitable for electromagnetic silicon steel plates but containing insufficient silicon and boron. The molten steel is divided when tapped out of a converter or after a vacuum degasifying steel making process, and silicon and boron are added with heating to create the desired composition. The molten steel is formed into thin amorphous alloy strip by quenching.

6 Claims, 7 Drawing Sheets

CONVENTIONAL PROCESS

CONVENTIONAL PROCESS

METHOD OF PRODUCING AMORPHOUS ALLOY THIN STRIP FOR COMMERCIAL FREQUENCY BAND TRANSFORMERS

BACKGROUND OF THE INVENTION

1. Field of the Invention

This invention relates to a method of producing a high-quality amorphous alloy thin strip as a new industrial product and at low production cost. The strip is highly useful for commercial frequency band transformers which typically have operating frequencies of 50Hz and 60Hz.

2. Description of the Related Art

Japanese Patent Application Laid-Open No. 57-116750 (Patent Family, EP55327, CA1215235) discloses an alloy for use in the production of amorphous alloy thin strip for commercial frequency band transformers. The alloy disclosed is at least 90% amorphous and has a composition which can be substantially expressed by the formula $Fe_aSi_bB_c$, where "$a$", "$b$" and "$c$" respectively represent approximately 75 to 78.5 atomic %, approximately 4 to 10.5 atomic %, and approximately 11 to 21 atomic %, the sum of "$a$", "$b$" and "$c$" being 100.

Conventionally, amorphous alloys for commercial frequency band transformers have been produced in the manner as shown in FIG. 6 of the drawings, where the materials are fed into a melting furnace 17 and, after adjustment of composition and temperature, are formed into a thin strip by quenching. The materials used in the process are agglomerated after smelting and then melted again. Referring to FIG. 6, numeral 11 indicates a tundish; numeral 12 a cooling roll; and numeral 15 a device for taking up the strip 14.

The electric melting furnace system in which the materials are melted again presents various problems. For example, it requires use of high-purity ferroboron, which is rather expensive. Further, the system requires a high-quality iron source since the process it performs is incapable of eliminating impurities. In addition, it involves energy loss, reduction in material yield, difficulty in achieving mass production due to the melting in small amounts and other problems.

Thus, there has been no optimum process available for effective mass production of an amorphous alloy for use in commercial frequency band transformers.

In the field of steel production, an electromagnetic silicon steel plate production technique has also been established. For example, high-quality molten steel may be obtained through a series of processes using, as shown in FIG. 7 of the drawings, a blast furnace 1, hot metal pre-processing apparatuses 2 and 4, a converter 5, and, as needed, a vacuum degasifying apparatus.

This molten steel, intended for the production of electromagnetic silicon steel plates differs significantly, however, from amorphous alloy thin strip useful in commercial frequency band transformers, with important differences of boron and silicon contents.

If the composition of the electromagnetic silicon steel of the prior art were adjusted to the formula of the amorphous alloy by the process of the prior art, boron contamination would occur, resulting in other process materials being contaminated. Further, it should be noted that the melting of the prior art molten steel for the production of electromagnetic silicon steel plates is effected in the order of several hundreds of tons, which is too large for the production of an amorphous alloy in terms of heat size.

Thus, in actual practice, the prior art process cannot be employed for the effective commercial production of a high-quality amorphous alloy thin strip.

SUMMARY OF THE INVENTION

It is an object of this invention to provide a method of producing amorphous alloy thin strip for use in commercial frequency band transformers, on an industrial scale with high quality and at low production cost.

In accordance with this invention high-quality molten steel suitable for electromagnetic silicon steel plates may be utilized as an inexpensive molten steel source. The composition of this molten steel, however, is such that it contains 3.5% or less of silicon and essentially no boron. Thus, to use it to make an amorphous alloy for commercial frequency band transformers, it is necessary to add silicon and boron to the molten steel.

FIG. 7, previously noted, is a diagram schematically illustrating a conventional process for producing slabs for electromagnetic silicon steel plates. In the process the elements Si, S and P are removed from the molten metal tapped out of the blast furnace 1, as it passes through the runner and through a torpedo 3, by using the hot metal pre-processing apparatuses 2 and 4. Then, the molten metal undergoes decarbonization in the converter 5 and a second smelting, as needed, by an RH vacuum degasifying apparatus 7. After that, the molten metal is subjected to continuous casting by way of a ladle 8 and solidifies in a mold 9 and is formed into a slab.

However, to use this molten steel for the production of an amorphous alloy, it would be necessary to solve the problem of the silicon/boron contents and the problem of excessive volume or heat size as described above.

In view of this, in accordance with the present invention, the molten steel for electromagnetic silicon steel plates containing 3.5% or less of silicon is divided when tapped out of the converter or after the vacuum degasifying process, and, after that, silicon and boron are added while heating the steel, thereby obtaining the desired amount of molten metal for making the amorphous strip, adjusted to the desired percentages of silicon and boron.

BRIEF SUMMARY OF THE INVENTION

In the present invention the adding of silicon and boron is effected after division and may be effected at any time after division and before the start of casting by quenching. However, it is desirable that addition of silicon and boron be effected along with arc heating or heating with vacuum degasification. Alternatively, the molten steel may be divided and transferred to a heating/retaining furnace, and silicon and boron added there to adjust the composition and temperature of the steel.

DESCRIPTION OF THE PREFERRED EMBODIMENTS

Figure 1:
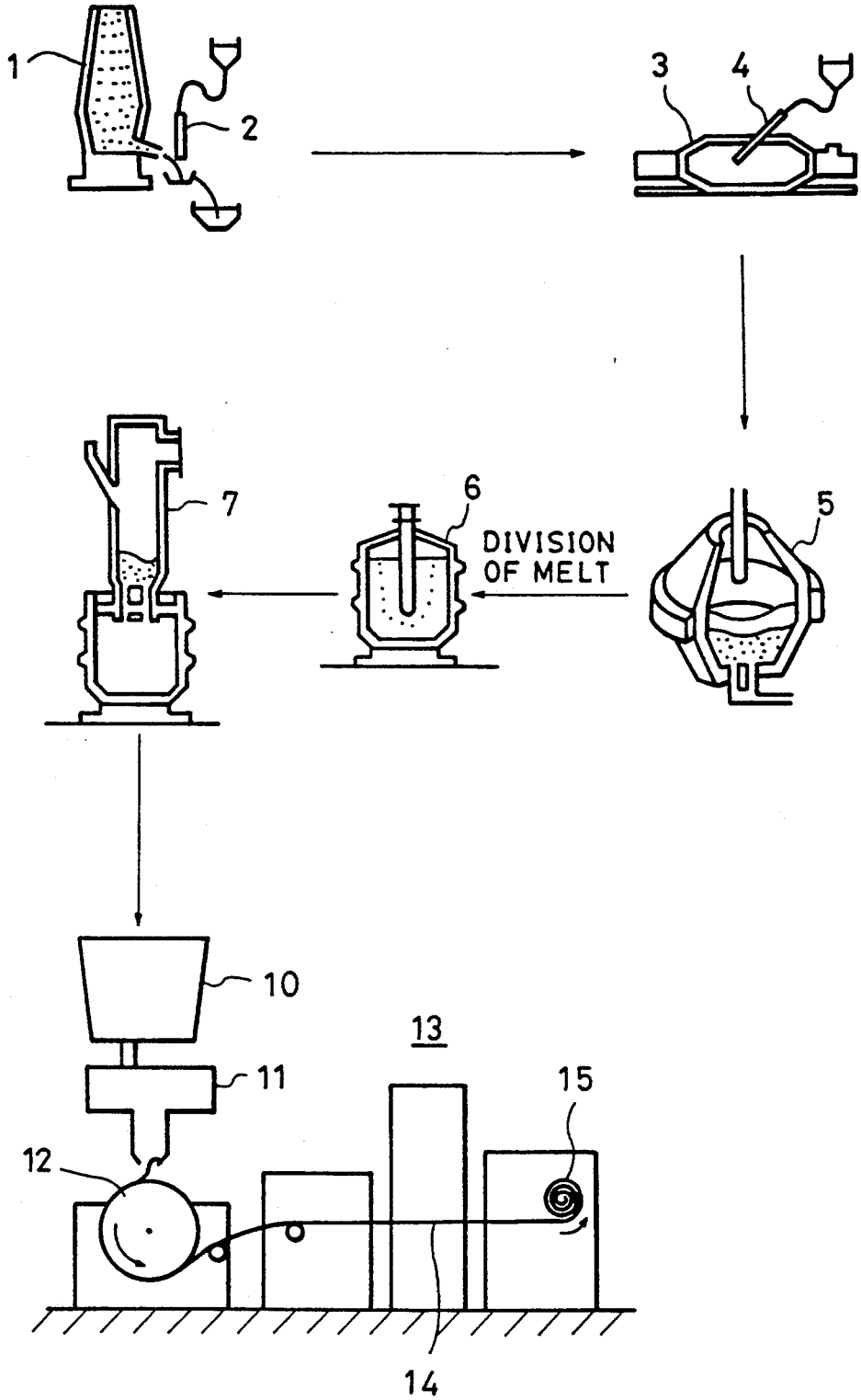
FIG. 1 is a diagram schematically illustrating a production process according to one embodiment of the present invention.

Referring to FIG. 1, molten iron tapped out of the blast furnace 1 is pre-smelted by the molten-metal pre-processing apparatus 2, and is further pre-smelted by the molten-metal pre-processing apparatus 4 in the torpedo, car 3. The pre-smelted molten metal is smelted in a top-blown oxygen converter 5, thereby producing a high-quality molten metal of a quality effective to be used in the production of electromagnetic silicon steel plates, but containing only 3.5% or less of Si.

The molten steel from converter 5, intended to be adjusted as to silicon and boron content, and to be made into an amorphous alloy thin strip, is divided and fed into an arc heating furnace 6. At the arc heating furnace predetermined amounts of silicon and boron are added to the molten metal while raising its temperature or compensating for any cooling effect due to the introduction of the silicon and boron. The molten steel is then adjusted to the desired predetermined final composition by a vacuum degasifying furnace 7. After that, the molten steel is conveyed by a ladle 10, tundish 11 and cooling roll 12 up to a casting machine 13 for continuously casting an amorphous alloy thin strip according to this invention. In the casting machine 13, the molten metal flow rate is controlled by the tundish 11 and rapid cooling is effected by the cooling roll 12, thereby producing a thin strip 14. Numeral 15 indicates a device for taking up the thin strip 14.

It will accordingly be appreciated that the process according to this invention is effective for producing amorphous alloy materials in a steel making process in mass production, enabling inexpensive production of the amorphous alloy without impairing the conventional steel making process. In the steel making process, boron has an especially detrimental effect on many steel products; therefore, amorphous alloys themselves cannot be produced in the conventional steel making process. The process of this invention, utilizing a division of the melt, allows the molten steel used in the production of silicon steel plate to be used to produce a molten metal of higher quality.

The composition of the molten steel from the steel making process, however, contains only 3.5% or less of silicon and essentially no boron. It is therefore necessary to add Si and B to this molten steel.

For adding the Si and B into the molten steel, it is convenient and effective to add cold charges such as cold Fe-Si alloy and cold Fe-B alloy into the molten steel. These cold charges tend to lower the temperature of the molten steel; thus a heating furnace is concurrently provided. Because of the inconvenience of transferring the molten steel with the above alloys to a heating furnace, an arc heating method as in FIG. 1 is most advantageously employed, in which the molten metal—even a small amount of this—can be easily heated in the ladle.

Figure 2:
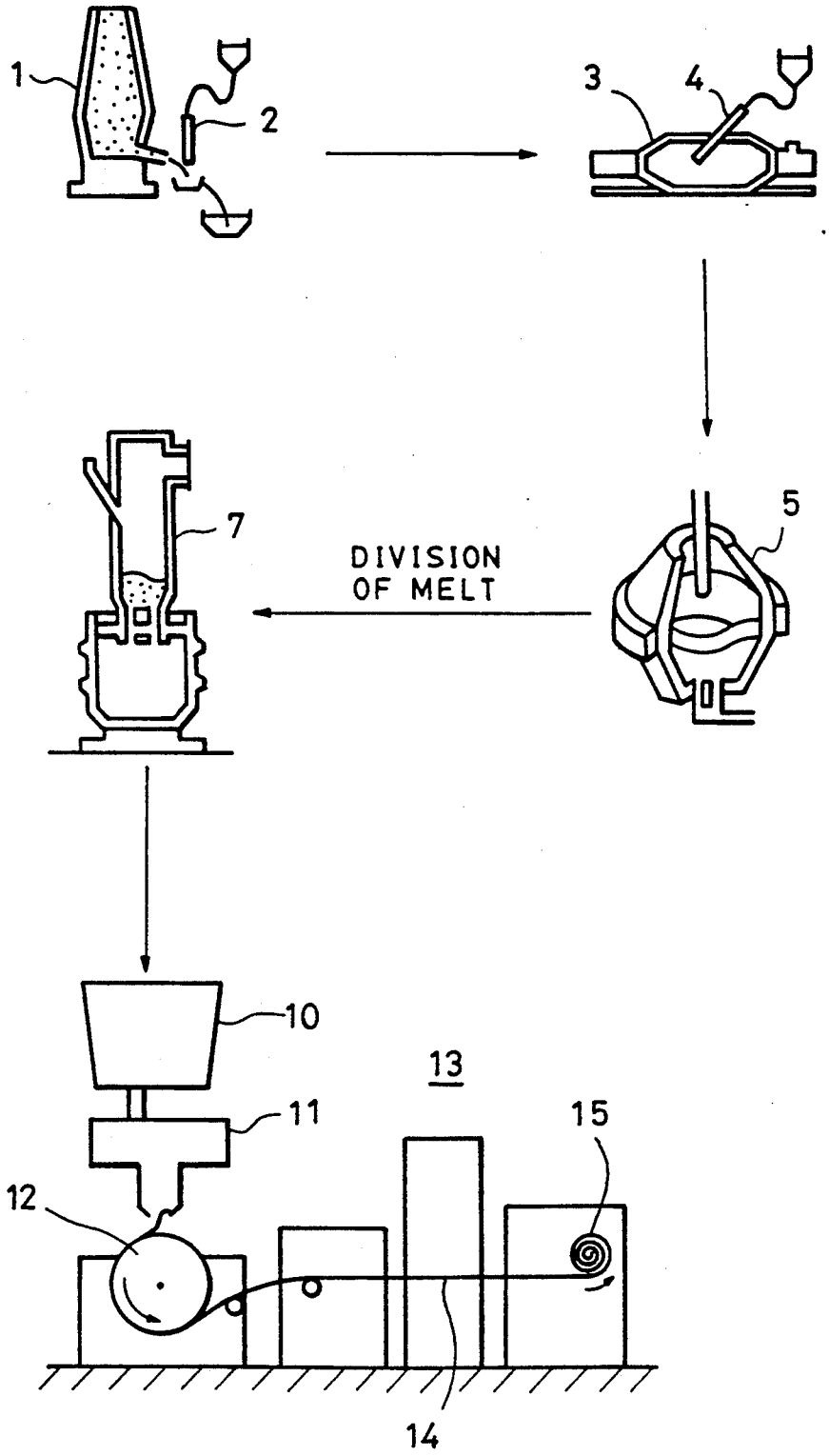
FIG. 2 is a diagram schematically illustrating a production process according to another embodiment of the present invention.

Referring to FIG. 2, showing a different embodiment, molten iron tapped out of the blast furnace 1 is presmelted by the molten-iron pre-processing apparatus 2 and is further pre-smelted by the molten-iron pre-processing apparatus 4 in the torpedo car 3. Next, the pre-smelted molten iron is smelted by a top-blown oxygen converter 5, thereby producing a high-quality molten steel whose Si content is adjusted to 3.5% or less and which is suitable for use in the production of electromagnetic silicon steel plates. This portion of the apparatus is similar to FIG. 1.

The molten steel from converter 5 is divided and fed into the vacuum degasifying furnace 7 (as distinguished from the arc heating furnace 6 of FIG. 1), where it undergoes degasification. At the same time the requisite amounts of silicon and boron are added, with heating, to adjust the steel to its final composition.

After that, a thin strip is produced from the molten steel by a process similar to that of FIG. 1.

A vacuum degasifying furnace is especially useful in the practice of this invention. There is a severe restriction on allowable impurities in the molten metal of the amorphous alloy. According to this invention, the final adjustment of the amorphous composition can be facilitated by utilizing a vacuum degasifying process while the Fe-Si alloy and the Fe-B alloy are being added and heated. This allows the use of relatively low grade or inexpensive additives, e.g. materials having low levels of Fe-B alloy purity. Cost reduction in a significant amount can be achieved because the composition of the final product can be adjusted to a value within an acceptable range with the use of the vacuum degasifying furnace.

Figure 3:
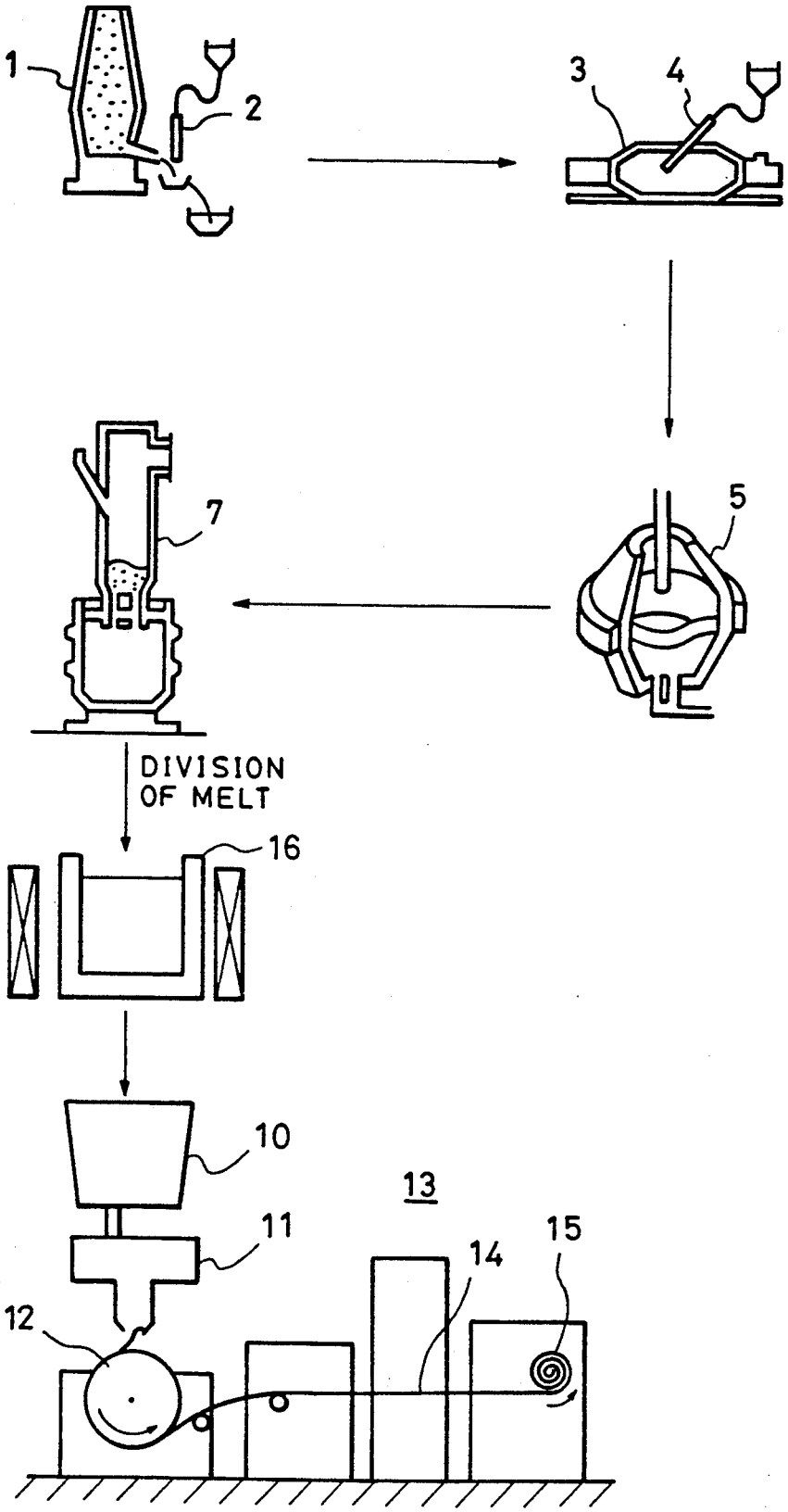
FIG. 3 is a diagram schematically illustrating a production process according to still another embodiment of the present invention.

Referring to FIG. 3, according to a still different embodiment, molten iron tapped out of the blast furnace 1 is pre-smelted by the molten-iron pre-processing apparatus 2 and further pre-smelted by the molten-iron pre-processing apparatus 4 in the torpedo car 3. Next, the pre-smelted molten iron is smelted by the top-blown oxygen converter 5 and is degasified by a vacuum degasifying apparatus 7 in a manner similar to FIG. 2, thereby producing a high-quality molten steel whose Si content is adjusted to 3.5% or less and which is useful for the production of electromagnetic silicon steel plates.

This molten steel is divided and fed into a heating-/retaining furnace 16, where requisite amounts of silicon and boron are added, with heating, to adjust the steel to the desired final composition while raising the temperature of the molten steel. After that, thin plates are produced from this molten steel by a process similar to FIGS. 1 and 2.

Using a heating/retaining furnace 16 similarly enables temperature compensation for temperature reduction caused by the addition of cold materials such as ferrosilicon or ferroboron. As is shown in FIG. 3, it is possible to add these cold materials bit by bit while achieving effective compensation for the resulting temperature reduction. In the process for producing the amorphous alloy, the plate thickness and width are so small that the rate of supply of the molten metal may be as small as approximately 1 Kg/sec, for example. In this case, a longer retaining period of the molten metal for keeping the temperature of the amorphous alloy is required. Accordingly, the heating/retaining furnace located upstream of the heating furnace shown in FIG. 3 guarantees more accurate temperature control and provides better conditions for making the thin strip alloy.

In the practice of this invention, when vacuum degasification is conducted after dividing the molten metal, it is necessary to employ a vacuum degasifying furnace having a size adapted to the volume of the molten iron in the divided state.

It has been discovered that the present invention has created a way to produce an amorphous alloy thin strip for commercial frequency band transformers which has a composition, by weight %, of 2.5 to 3.5% of B, 4.5 to 5.5% of Si, 0.05 to 0.15% of C, 0.01% or less of Al, 0.005% or less of Ti, 0.01% or less of S, 0.02% or less of P, 0.005% or less of N, a residue of Fe and incidental impurities.

Magnetic measurement in a magnetic field after annealing shows that an amorphous alloy thin strip having a composition according to this invention provides an iron loss value $W_{13/50} \leqq 0.12$ (W/kg). A very significant reduction has been attained particularly in regard to important impurities, such as Al and Ti, which degrade the magnetic characteristics of the steel.

Figure 4:
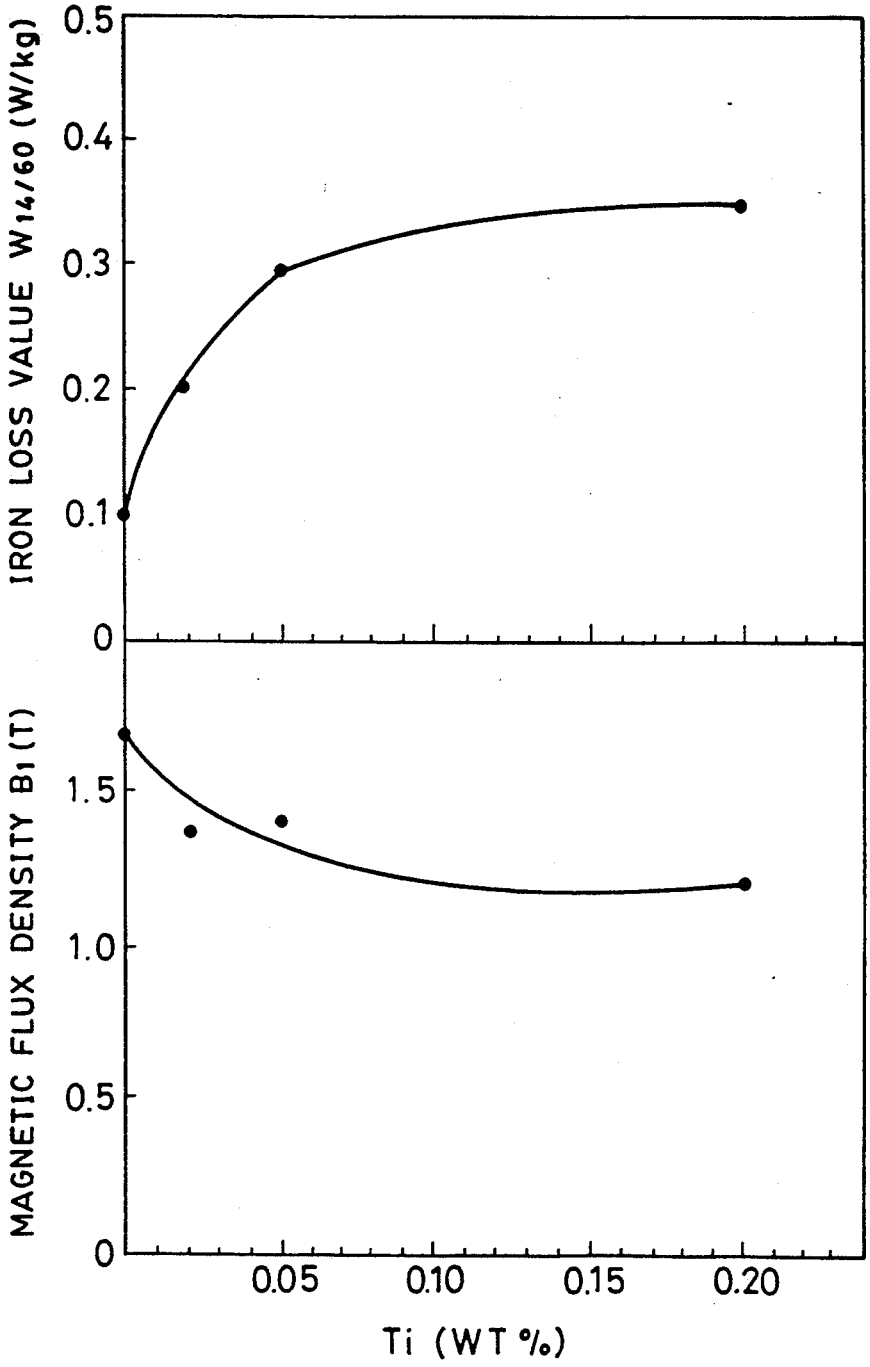
FIG. 4 is a diagram illustrating a relationship between Ti content, magnetic flux density and iron loss value.

FIG. 4 illustrates a relationship between Ti content, magnetic flux density $B_1(T)$, and iron loss value $W_{14/60}$ (W/kg) with respect to an amorphous alloy thin strip for use in commercial frequency band transformers. The steel has a composition of $(Fe_{78}B_{13}Si_9)_{100-x}$ $Ti_x$ and has been subjected to vacuum annealing.

The method of the present invention makes it possible to produce a thin strip containing as little as 0.005 wt % or less of Ti. Thus, the method is strongly instrumental in creating a product having very excellent magnetic properties.

Figure 5:
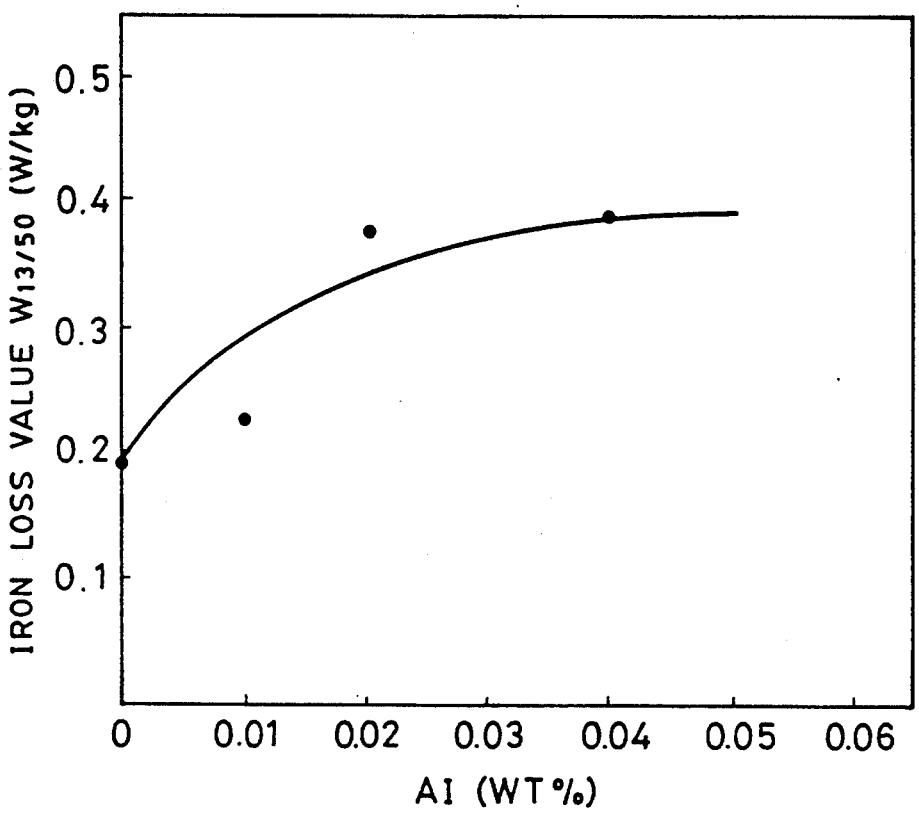
FIG. 5 is a diagram illustrating a relationship between A1 content and iron loss value.

FIG. 5 illustrates a relationship between Al content and iron loss value $W_{13/50}$ (W/kg) with respect to an amorphous alloy thin strip for use in commercial frequency band transformers. The alloy steel has a composition of $(Fe_{92}B_3Si_5)$ Alx and has been subjected to vacuum annealing.

The method of the present invention allows production of a thin strip containing as little as 0.001 wt % or less of A1. Thus, the method is strongly instrumental in creating a product having excellent magnetic properties.

EXAMPLES

The following examples are intended to illustrate several specific forms of the invention, to illustrate how it may be practiced, but are not intended to limit the scope of the invention, which is defined in the claims.

Example 1

A thin strip having a width of 150 mm was produced by the process of FIG. 1 as follows:

Molten iron was pre-processed in the apparatus 2 and the torpedo car 3 to remove Si, P and S therefrom. Afterwards, it was decarbonized by a top-blown oxygen converter 5 having a heat size of 250 tons to effect primary smelting. The molten steel for electromagnetic silicon steel plates, which contained at this stage approximately 3.3% of Si, was poured in 50-ton units, and fed into the arc heating apparatus 6, where ferrosilicon and ferroboron were added thereto while raising the temperature thereof by heating so as to remove oxygen, hydrogen, carbon and nitrogen therefrom. Further, final composition adjustment and temperature adjustment (1300° C., at the time of tapping) were effected by the RH vacuum processing furnace 7. The composition in weight % of the molten metal at this stage was as follows: 3.1% of B, 5.2% of Si, 0.05% of C, 0.005% of Al, 0.003% of Ti, 0.005% of S, 0.01% of P, 0.005% of 0, 0.003% of N, a residue of Fe, and incidental impurities.

The RH vacuum processing furnace 7 used was one for a heat size of 50 tons.

Then, the molten steel was transferred to the ladle 11, and an amorphous alloy thin strip (having a width of 150mm and a thickness of 20μm) was continuously produced by quenching. Further, by subjecting the thin strip to a one-hour vacuum annealing in a magnetic field at 375° C., a single-plate iron loss value of 0.10 (W/kg) was obtained.

Example 2

A thin strip having a width of 150mm was produced by the process of FIG. 2 as follows: After primary smelting by the converter 5, molten iron was subjected to degasification by the RH degasifying apparatus 7 to produce molten metal for a silicon steel containing 3.3% of silicon. 50 tons of this molten metal was poured, and ferrosilicon and ferroboron were added thereto in an Ar atmosphere in the heating/retaining furnace 10, thereby producing molten steel at 1320° C., which had a composition similar to that of Example 1, containing 3.0% of B, 5.1% of Si, 0.06% of C, 0.006% of Al, 0.003% of Ti, 0.004% of S, 0.01% of P, 0.006% of O, 0.005% of N, a residue of Fe, and incidental impurities.

After that, the molten steel was formed into a thin strip having a thickness of 20μm, which exhibited, upon magnetic measurement after annealing, an iron loss value $W_{13/50}$ of 0.11 (W/kg).

Further, substantially the same results as those of Examples 1 and 2 were obtained by a further test using the process of FIG. 3.

Comparative Example

Figure 6:
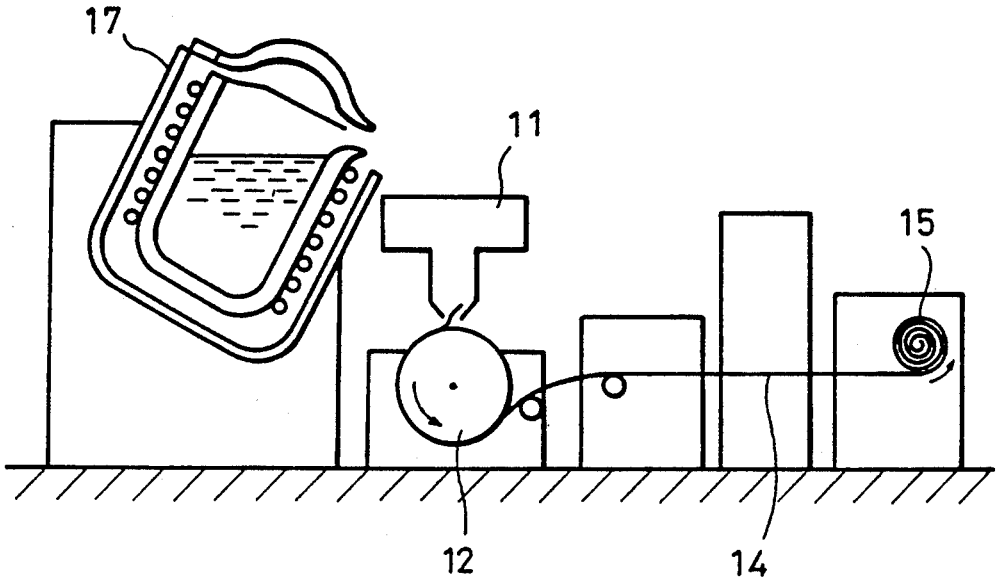
FIG. 6 is a diagram illustrating a conventional process for producing an amorphous alloy thin strip for commercial frequency band transformers.
Figure 7:
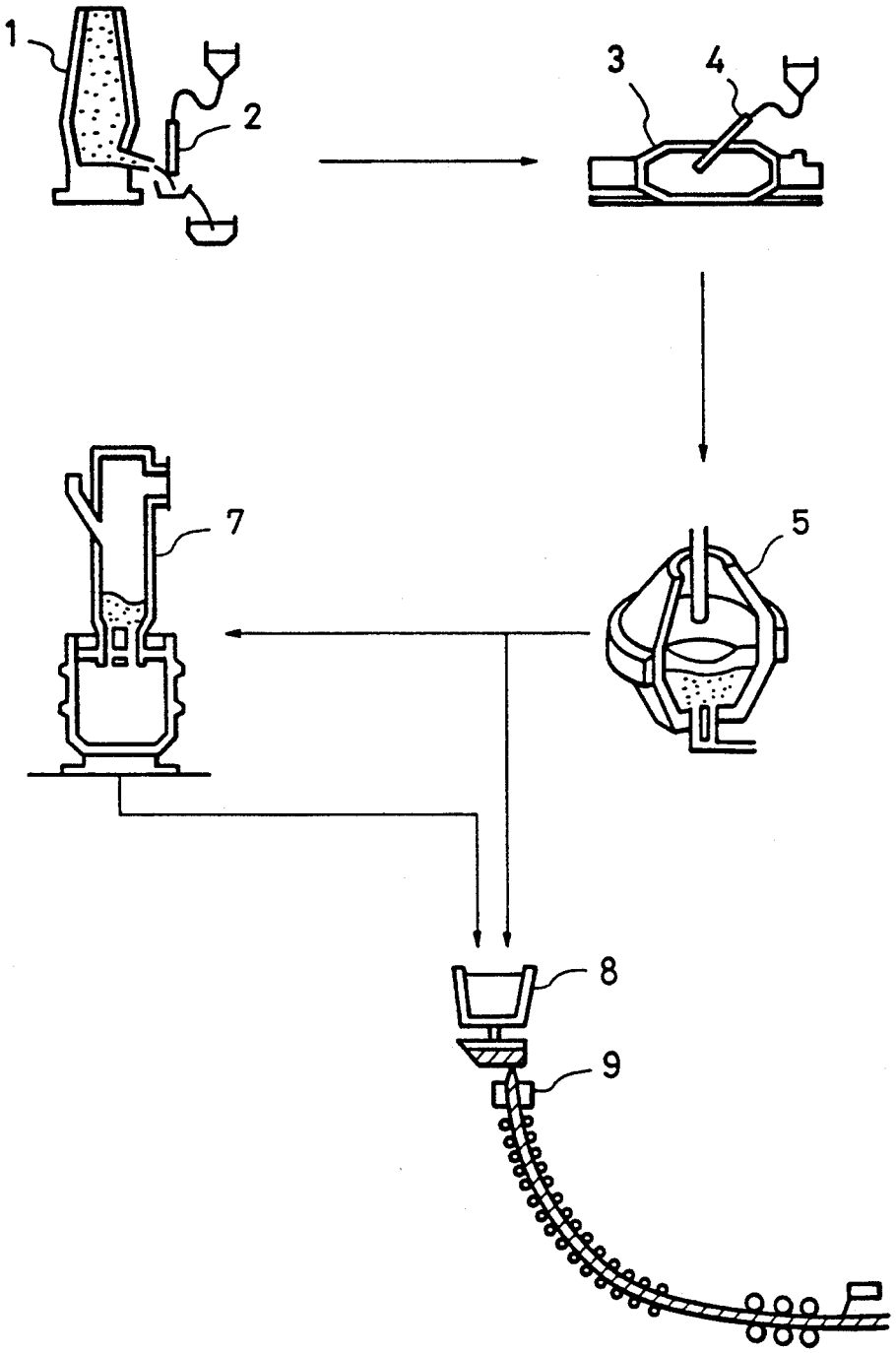
FIG. 7 is a diagram of a conventional process schematically illustrating how a molten metal is used in the production of electromagnetic silicon steel plates.

Molten metal prepared in the same manner as in Examples 1 and 2 was poured into a mold to produce a master alloy. Two tons of this master alloy was fed into the melting furnace 15 of the apparatus shown in FIG. 6 and was melted again by high frequency melting in an Ar atmosphere. The O and N contents of the resultant molten metal were larger than those of Examples 1 and 2, and the master alloy required $10^6$ kcal of energy for re-melting.

Although the heat size of the melting furnace 15 was two tons, the production of thin strip was as small as 1.9 tons.

To continue production, the master alloy had to be melted again, so that it was necessary to effect nozzle changing, pre-heating and roll re-polishing, resulting in a large waste of time and energy.

As described above, the method of the present invention enables achievement of mass production of an amorphous alloy thin strip for use in commercial frequency band transformers on an industrial scale and at low cost.

Furthermore, the method of this invention achieves excellent product quality stabilization and energy saving.

It will be appreciated that the silicon and boron may be added as elements or combined with iron as ferrosilicon, ferroboron or the like, provided the materials added do not contain harmful amounts of other elements or impurities. The process may be modified in various other ways, as will readily be understood by persons skilled in the art, without departing from the spirit and scope of the invention as defined in the claims.

What is claimed is:

1. A method of producing amorphous alloy thin strip for commercial frequency band transformers, comprising the steps of: pre-smelting molten metal tapped out of a blast furnace; further smelting the molten metal by a converter to obtain a high-quality molten steel for use in the production of electromagnetic silicon steel plates whose silicon content is about 3.5% or less; pouring said molten steel in a divided state into an arc heating furnace; adding requisite amounts of silicon and boron to the molten steel in said arc heating furnace heating the molten steel; adjusting this molten steel to a final composition in a vacuum degasifying apparatus; and producing an amorphous alloy thin strip from this molten steel by quenching.

2. A method of producing amorphous alloy thin strip for commercial frequency band transformers, comprising the steps of: pre-smelting molten metal tapped out of a blast furnace; further smelting the molten metal by a converter to obtain a high-quality molten steel for use in the production of electromagnetic silicon steel plates whose silicon content is about 3.5% or less; pouring said molten steel in a divided state into a vacuum degasifying furnace; degasifying the molten steel in said vacuum degasifying furnace and adding requisite amounts of silicon and boron to adjust said steel to a final composition; and producing an amorphous alloy thin strip from this molten steel by quenching.

3. A method of producing amorphous alloy thin strip for commercial frequency band transformers, comprising the steps of: pre-smelting molten metal tapped out of a blast furnace; further smelting the molten metal by a converter; degasifying the molten steel by a vacuum degasifying apparatus to obtain a high-quality molten steel for use in the production of electromagnetic silicon steel plates whose silicon content is about 3.5% or less; pouring said molten steel in a divided state into a heating/retaining furnace; adding requisite amounts of silicon and boron to the molten steel in said heating/retaining furnace while heating the molten steel so as to adjust it to a final composition; and producing an amorphous alloy thin strip from this molten steel by quenching.

4. A method of producing amorphous alloy thin strip for commercial frequency band transformers according to one of claims 1, 2 and 3, wherein the amorphous alloy thin strip has the following approximate composition in weight %: 2.5 to 3 5% of B, 4.5 to 5.5% of Si, 0.05 to 0.15% of C, 0.01% or less of Al, 0.005% or less of Ti, 0.01% or less of S, 0.02% or less of P, 0.005% or less of N, a residue of Fe, and incidental impurities.

5. In a method of producing an amorphous alloy thin steel strip having a quality for use in commercial frequency band transformers from a molten steel that is suitable for production of electromagnetic silicon steel plates but which has a silicon content of about 3.5% or less, the steps which comprise:

a) pouring said molten steel in a divided state into a treating furnace while heating;

b) adding in said treating furnace requisite amounts of silicon and boron, with heating, to produce an amorphous strip comprising about 2.5–3.5% B and about 4.5–5.5% Si; and c) quenching the resulting steel composition to produce the amorphous strip.

6. The method defined in claim 5 wherein said treating furnace is selected from the group consisting of an arc heating furnace, a vacuum degasifying furnace and a heating/retaining furnace.

* * * * *

UNITED STATES PATENT AND TRADEMARK OFFICE

CERTIFICATE OF CORRECTION

PATENT NO. : 5,322,113

DATED : June 21, 1994

INVENTOR(S) : Kiyoshi Shibuya et al

It is certified that error appears in the above-indentified patent and that said Letters Patent is hereby corrected as shown below:

In Column 3, line 18, after "pedo" please delete the comma.

In Column 5, line 36, please delete "$(Fe_{92}B_3Si_5)$" and substitute --$(Fe_{92}B_3Si_5)_{100-x}$--.

In Column 6, line 11, after "value" please insert --$W_{13/50}$--.

Signed and Sealed this

Thirtieth Day of August, 1994

*Attest:*

*Attesting Officer*

BRUCE LEHMAN

*Commissioner of Patents and Trademarks*